US007441510B1

(12) United States Patent
Bach

(10) Patent No.: US 7,441,510 B1
(45) Date of Patent: Oct. 28, 2008

(54) MARINE WINDSHIELD FRAME AND METHOD OF MANUFACTURE

(76) Inventor: Darren Ashley Bach, 7993 Progress Way, Delta, British Columbia (CA) V4G 1A3

( * ) Notice: Subject to any disclaimer, the term of this patent is extended or adjusted under 35 U.S.C. 154(b) by 0 days.

(21) Appl. No.: 11/732,022

(22) Filed: Apr. 3, 2007

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 3,304,657 A * 2/1967 Singleton ..... 49/399
3,427,776 A * 2/1969 Box et al. ..... 52/204.591
4,970,946 A * 11/1990 Ivey ..... 454/130
5,906,697 A * 5/1999 Hasegawa et al. ..... 156/108

* cited by examiner

*Primary Examiner*—Sherman Basinger

(57) ABSTRACT

A marine windshield frame for curved or straight windshield glass having a top frame rail mounted inward of the windshield glass and substantially flush with frontal surface of the windshield glass. The top frame rail is mounted onto the windshield glass edge by adhesive. The windshield frame may also include a pair of vertically oriented corner posts. The corner posts are preferably manufactured by die-cast molding. An alternate manufacturing method is to stretch-form an aluminum alloy extrusion, matching vent holes therein, and machined a taper thereon an edge.

24 Claims, 14 Drawing Sheets

MARINE WINDSHIELD FRAME AND METHOD OF MANUFACTURE

TECHNICAL FIELD

The invention relates to a marine windshield frame and method of manufacture, and more specifically to a narrow adhesive mounted top frame rail, substantially flush with the frontal surface of the windshield glass and may also employ a pair of dramatically tapered corner posts.

BACKGROUND OF THE INVENTION

Mounting, trimming or finishing the edges of marine windshields has become more complex over the years as the windshield shapes have progressed from simple rectangular panes to complexly gently curved, dramatically curved and obliquely oriented windshields, some of which are segmented and also allowing access to a forward seating area through a windshield hatch.

The most common approach currently in use is to employ an extrusion, which is stretch-formed on a die set to the curved shape of the edge of the windshield glass to be mounted. Usually the mounting and edge trimming extrusions are formed from aluminium extrusions and usually have a windshield receiving longitudinally extending channel therein. A gasket, such as a vinyl or thermoplastic gasket, is mounted between the windshield channel in the extrusion and the glass, so as to seal and cushion the windshield edge within the assembly.

Typical marine windshield frame extrusions that extend along the top and bottom edge, and sometimes, corners of the windshield, are as set forth in U.S. Pat. Nos. 6,800,160; 6,647,914; 5,601,050; 4,970,946; 3,654,648 and 3,016,548.

Accordingly, it is an object of the present invention to provide a windshield frame and method of manufacturing, which is well suited for use as a frame for most boat windshield glass including, curved, semi-curved, straight and corner posted boat windshields.

Another object of the present invention is to provide a method of manufacture of a vented corner post allowing different vent hole configurations.

Yet another object of the present invention is to provide a method of manufacture of a vented corner post.

A further object of the present invention is to provide a vented corner post with added visibility through the vent holes.

Still a further object of the present invention is to provide a windshield frame with a significantly tapered shape for improved visibility and aesthetic values.

The marine windshield frame and method of manufacture of the present invention has other objects and features of advantage which will become apparent from and are set forth in more detail in, the accompanying drawings and following details.

DISCLOSURE OF THE INVENTION

The marine windshield frame and method of manufacture of the present invention is designed to be stretch or die formed so as to fit along the frontal area of a boat deck, and comprises briefly, an elongated base member, longitudinally extending along the front and somewhat along the sides of the boat deck and including a windshield mounting rail. The windshield mounting rail includes an elongated windshield glass adhesion area, as described in U.S. patent application Ser. No. 11/155,942. The windshield frame assembly includes a longitudinally extending top windshield edge receiving structural rail, which also includes an elongated windshield glass adhesion area, where this top windshield edge receiving structural rail is affixed to the top rearward edge of the glass so as to be substantially flush with the frontal glass surface.

The windshield assembly may also include a pair of corner posts, where the corner posts may include vent holes therein. The vent holes can also be opened or closed from the cockpit, by sliding a cover up or down if desired. The vent cover fits into slots or tracks that run up and down the length of the corner post. The top of the corner post may be covered by a continuous top rail being bent around the top corner area, or by a cap that is screwed to the top of the corner post.

When the windshield frame includes a hatch to access the front deck of a boat, a corner connector is used to improve rigidity of the connection of the top windshield frame rail and vertically oriented hatch rail. The connector is made of plastic or other material. The corner connector block includes tabs, where the tabs insert into both the top windshield frame rail and the vertically oriented hatch rail during assembly.

The design of the corner post vent holes naturally provides a negative pressure in behind the windshield to vent the cockpit area. If a positive pressure is desired, an air scoop can be provided on the frontal surface of the corner post. This can be in the form of an external air scoop or an integrated hemispherical scoop that can be rotated within a vent hole.

The top vent hole on the starboard side is used to mount an optional mirror, where the mirror bracket is attached using a fastener that extends through the vent hole to a bracket that spans the inside of the vent hole. The mirror bracket mounts without any modification to the corner post.

The windshield frame rail members are typically made using suitable aluminium alloy extrusions, which are stretch-formed to the desired shape and then cut to length. The corner post can be made of a stretch-formed aluminium extrusion, or die-cast aluminium, or die-cast plastic, such as ABS plastic. The final part can be finished by a coated, using a variety of coatings methods and types for either the metal or plastic parts, adding most any desired aesthetic finish to the part.

In another aspect of the present invention, the manufacturing process, where the corner post is made of an aluminium alloy extrusion. The extrusion is then stretch-formed, and trimmed to length. To finished the shape a taper is created on at least one upper edge by machining off material. This trimming process is preferably executed robotically, and is done after the stretch-forming process. Thereby allowing a complex shaped part to be relatively inexpensive for smaller manufacturing runs.

It should be noted that the inward shape—towards the cockpit area—of the top rail can change depending on the angle of the windshield glass and the desired appearance, without the need to change the connection area and connection means, as well as the uppermost of the frontal area—towards the windshield glass—of the top rail.

BRIEF DESCRIPTION OF THE DRAWINGS

Advantages of the present invention will become more fully appreciated as the same becomes better understood when considered in conjunction with the following detailed description of an illustrative embodiment and accompanying drawings, in which like reference characters designate the same or similar parts throughout the several views, and wherein.

DETAILED DESCRIPTION OF THE PREFERRED EMBODIMENTS

Figure 1:
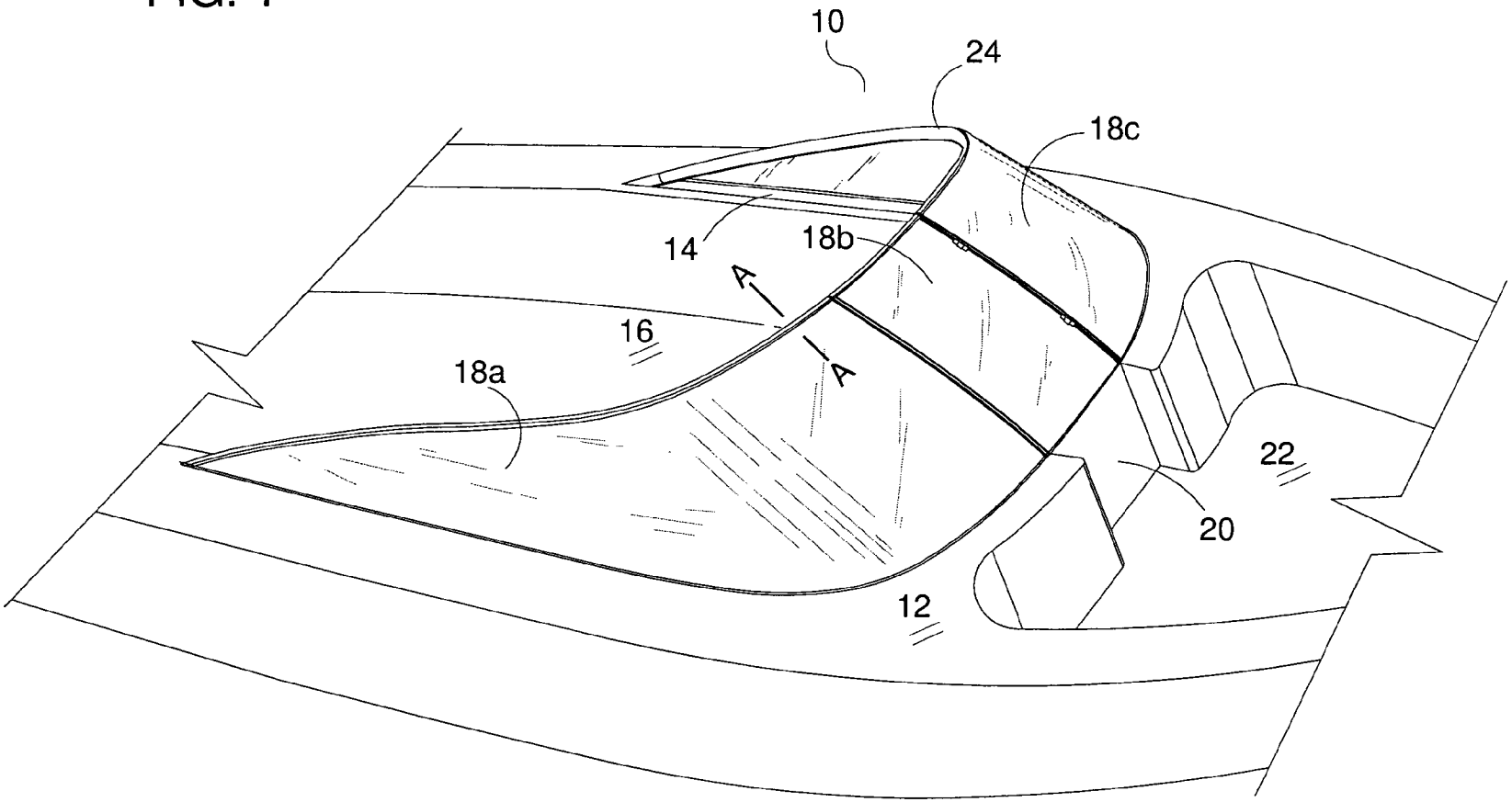
FIG. 1 is a perspective view of the preferred embodiment showing the invention mounted onto a boat deck and having a hatch segment for passage to the front deck area.

The marine windshield frame is generally referred to as 10 as shown in a perspective view in FIG. 1. A boat is shown in partial view where a deck 12 has windshield 10 mounted thereon deck 12, by means of windshield base frame rail 14. Windshield 10 is segmented, dramatically curved and swept back along the front sides of a cockpit area 16.

Windshield 10 includes windshield glass 18, where windshield glass 18 includes peripheral sections 18*a*, 18*b*, and 18*c*. Windshield section 18*b* is attached to a hatch door 20, where hatch 20 allows access to the front deck seating area 22. On top of glass sections 18*a*, 18*b* and 18*c* is longitudinally extending top windshield frame rail 24.

Figure 2:
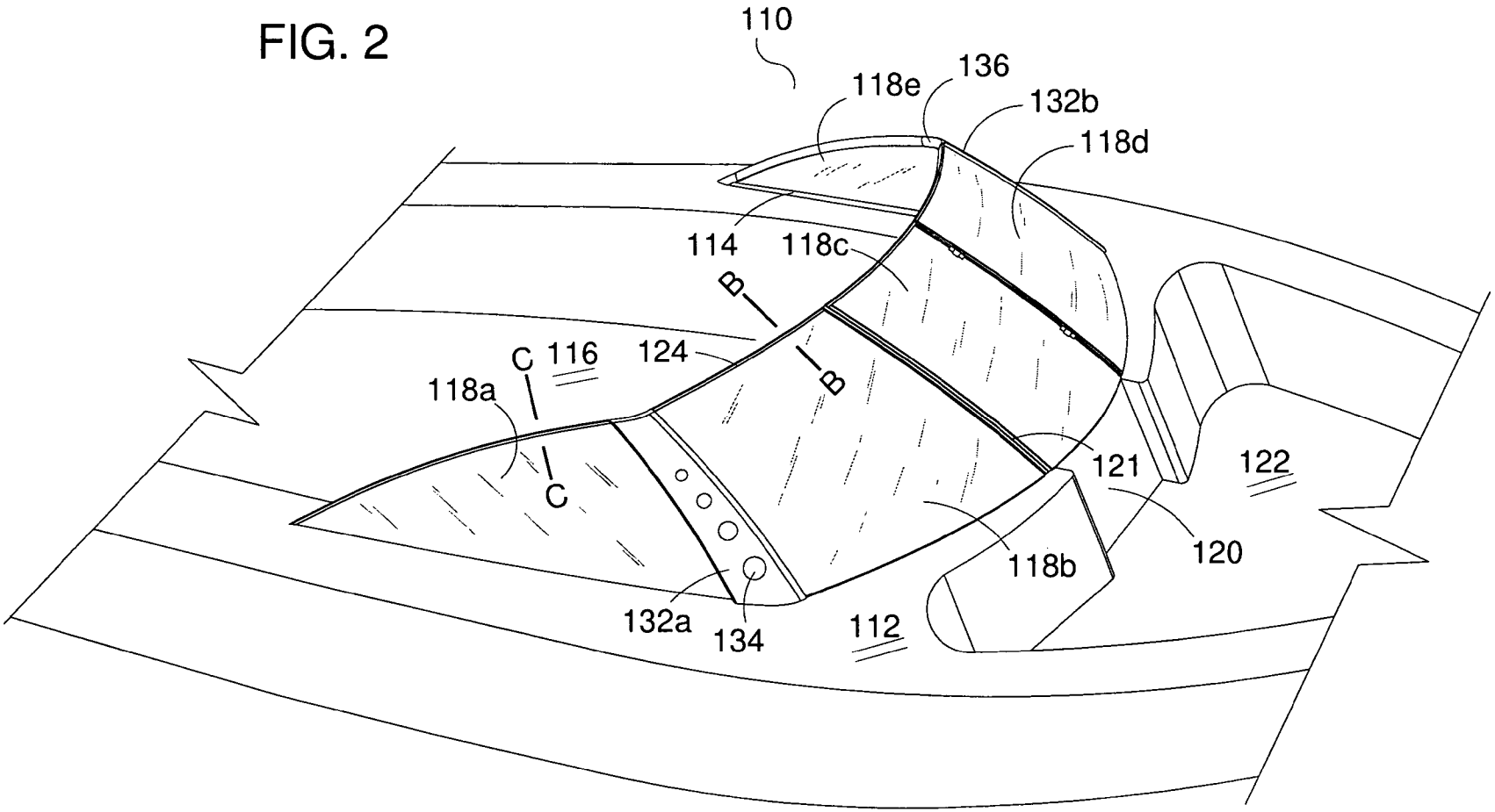
FIG. 2 is a perspective view of an alternate windshield assembly having vented corner post, showing the invention mounted onto a boat deck.

Alternate marine windshield frame as shown in a perspective view in FIG. 2, is generally referred to as 110. A boat is shown in partial view where a deck 112 has windshield 110 mounted thereon. Windshield 110 is segmented, gently curved and swept back along the front sides of a cockpit area 116.

Windshield 110 as shown in FIG. 2, where windshield glass 118 includes peripheral sections 118*a*, 118*b*, 118*c*, 118*d* and 118*e*. Windshield section 118*c* is attached to hatch door 120, where windshield section 118*c* and hatch door 120 allows access to the front deck seating area 122. On top of glass sections 118*b*, 118*c*, 118*d* and 118*e* is longitudinally extending top windshield frame rail 124.

Figure 3:
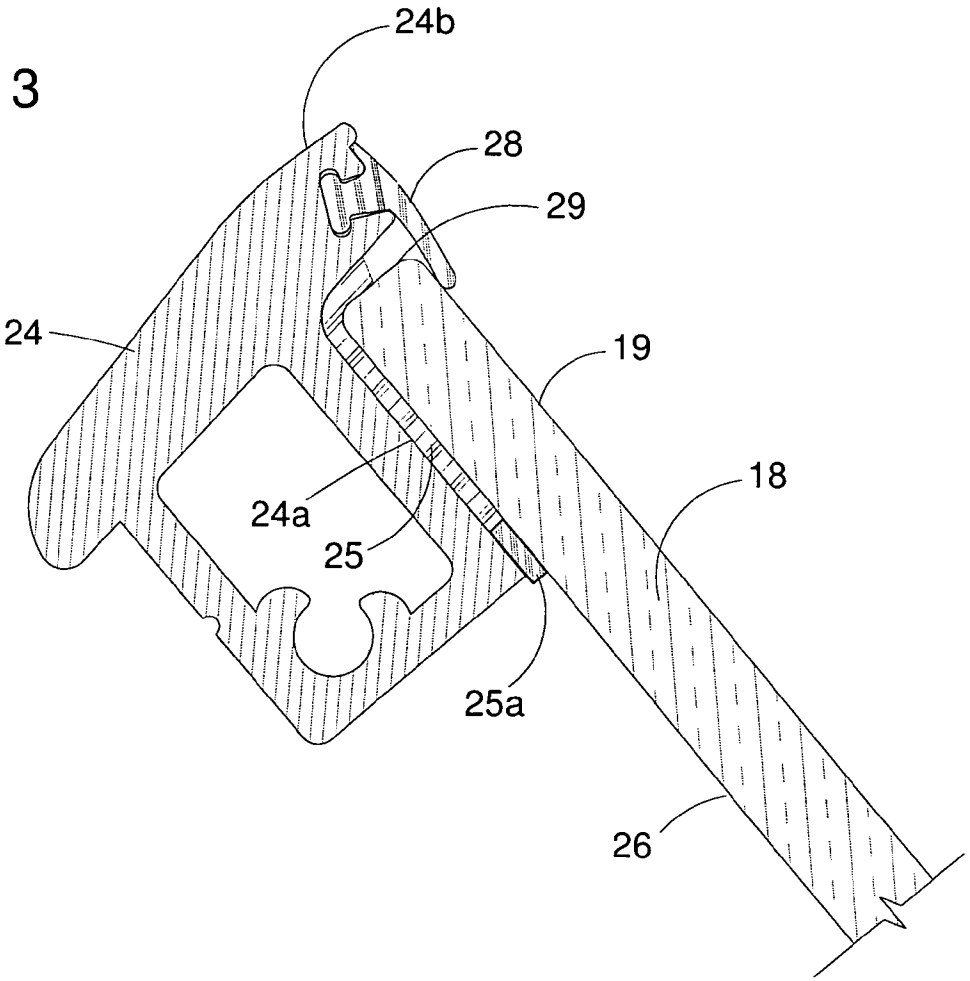
FIG. 3 is a segmented cross-sectional view of the top rail of the windshield frame taken along line A from FIG. 1 and as taken along line B from FIG. 2.

As shown in FIG. 3 a partial cross-sectional view taken along line A from FIG. 1, and also an identical section as taken along line B from FIG. 2, where the elongate top frame rail 24 is shown mounted substantially flush with windshield glass 18's exterior surface 19. The windshield glass 18 is shown adhesively fastened, or glued, where adhesive fastener 25 is shown between top rail 24's adhesive application surface 24*a* and windshield glass 18's interior surface 26. Also, a double adhesive strip 25*a* is used where double adhesive strip 25*a* is applied during assemble to control adhesive spread, thereby creating a clean glue edge on the interior surface 26 of windshield glass 18.

Also shown in FIG. 3 is a pliable strip 28, where strip 28 is attached to form a clean transition of upper glass edge 29 with the top rail 24, therefore creating a substantial flush seam between the front exterior surface 19 of windshield glass 18 and the upper surface 24*b* of top rail 24.

Figure 3A:
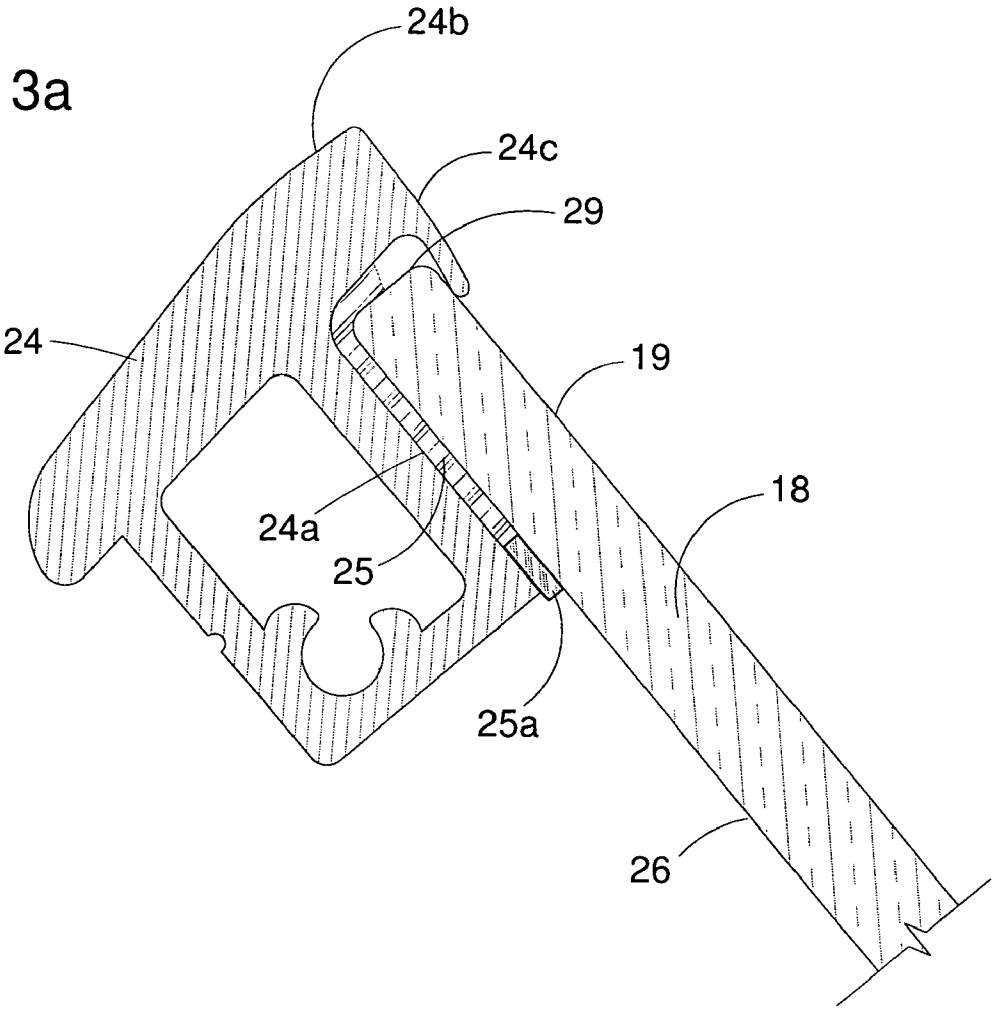
FIG. 3*a* is a segmented cross-sectional view of an alternate top rail of the windshield frame taken along line A from FIG. 1 and as taken along line B from FIG. 2.

As shown in FIG. 3*a* the top rail 24 includes a lip 24*c*, where lip 24*c* creates a substantial flush seam between the front exterior surface 19 of windshield glass 18 and the upper surface 24*b* of top rail 24.

Also, as best viewed in FIG. 2, alternate windshield frame 110 includes a pair of vertically oriented corner posts 132*a* and 132*b*, where corner posts 132*a* and 132*b* mate with base frame rail 114 and top frame rail 124.

Figure 4:
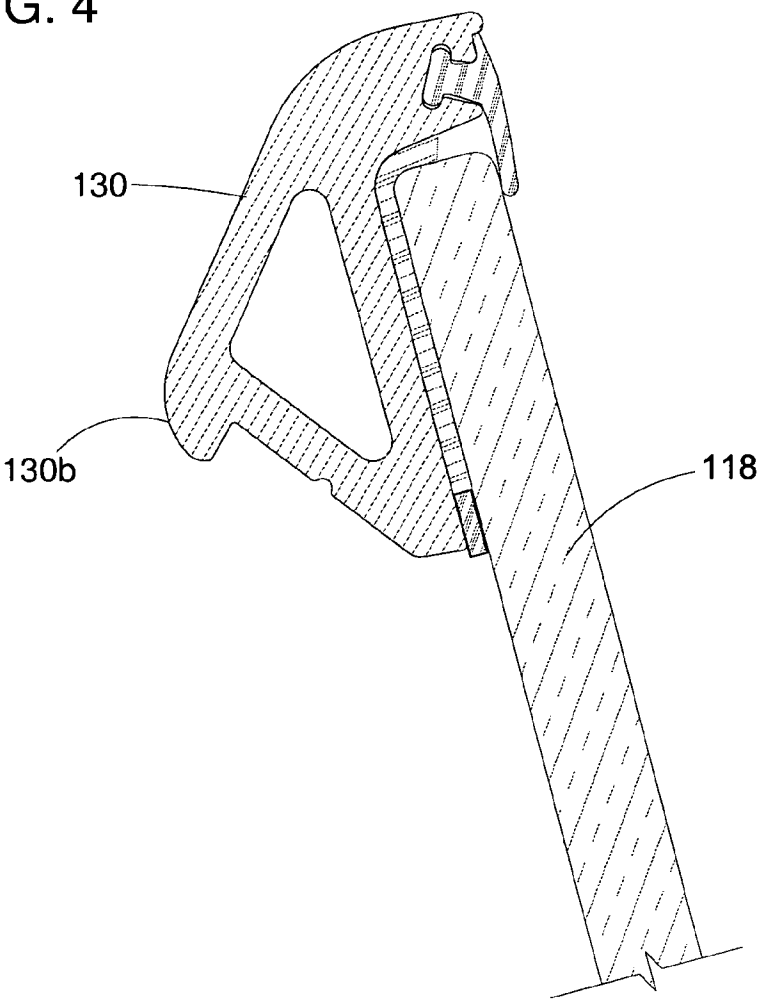
FIG. 4 is a segmented cross-sectional view of an alternate top rail of the windshield frame taken along line C from FIG. 2.

As shown in FIG. 4 a partial cross-sectional view taken along line C from FIG. 2 of windshield frame 110, where an alternate rearward top frame rail 130 is utilized to reduce protrusion of top rail inner edge 130*b* towards cockpit area 116, on the lesser sloped peripheral rearward windshield sections 118*a*.

Figure 5:
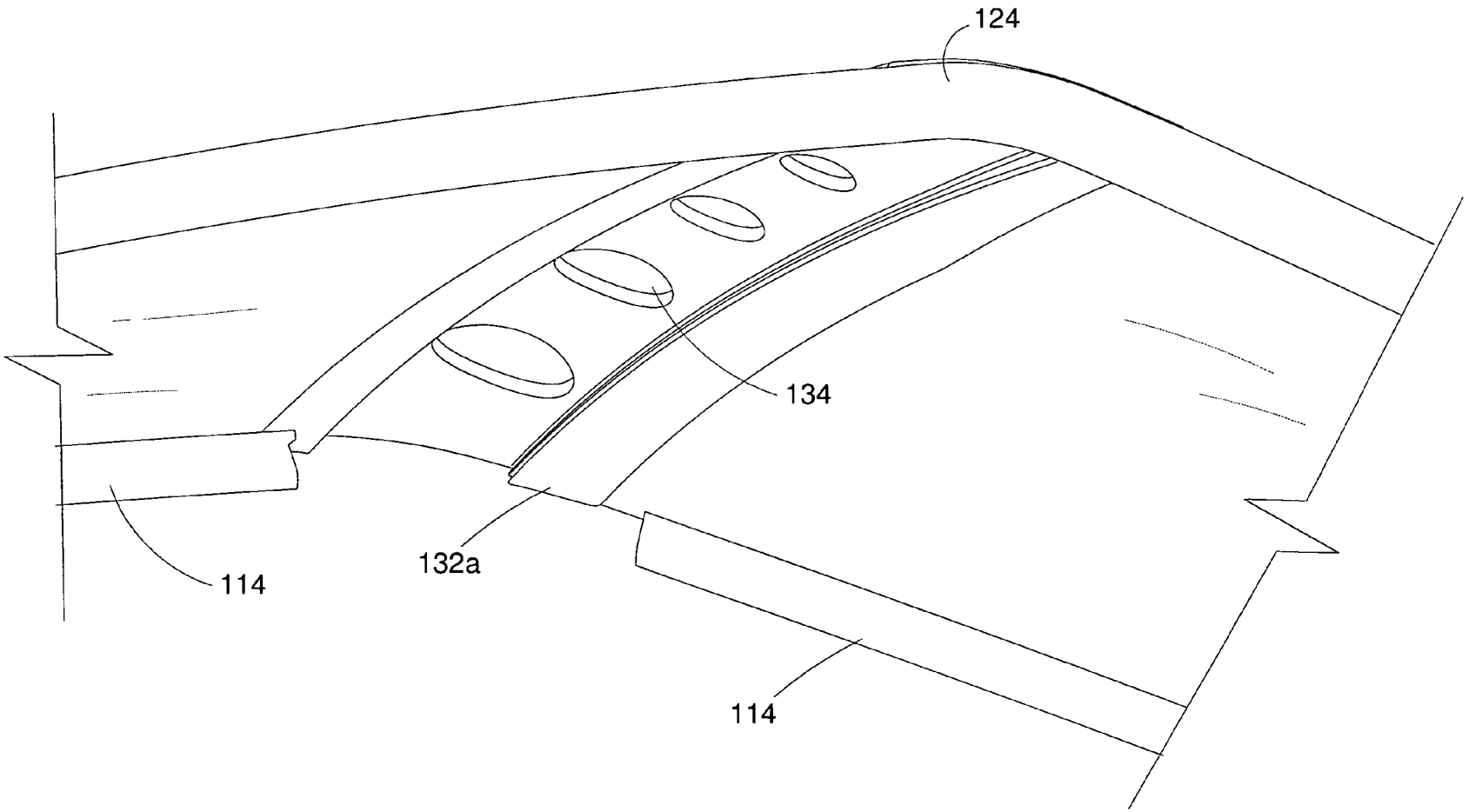
FIG. 5 is a segmented perspective view as viewed from above the cockpit area showing a continuous top rail.

As shown in FIG. 5 a partial perspective view of windshield frame 110 as viewed from just above the cockpit area 116, showing a continuous top rail 124.

Figure 6:
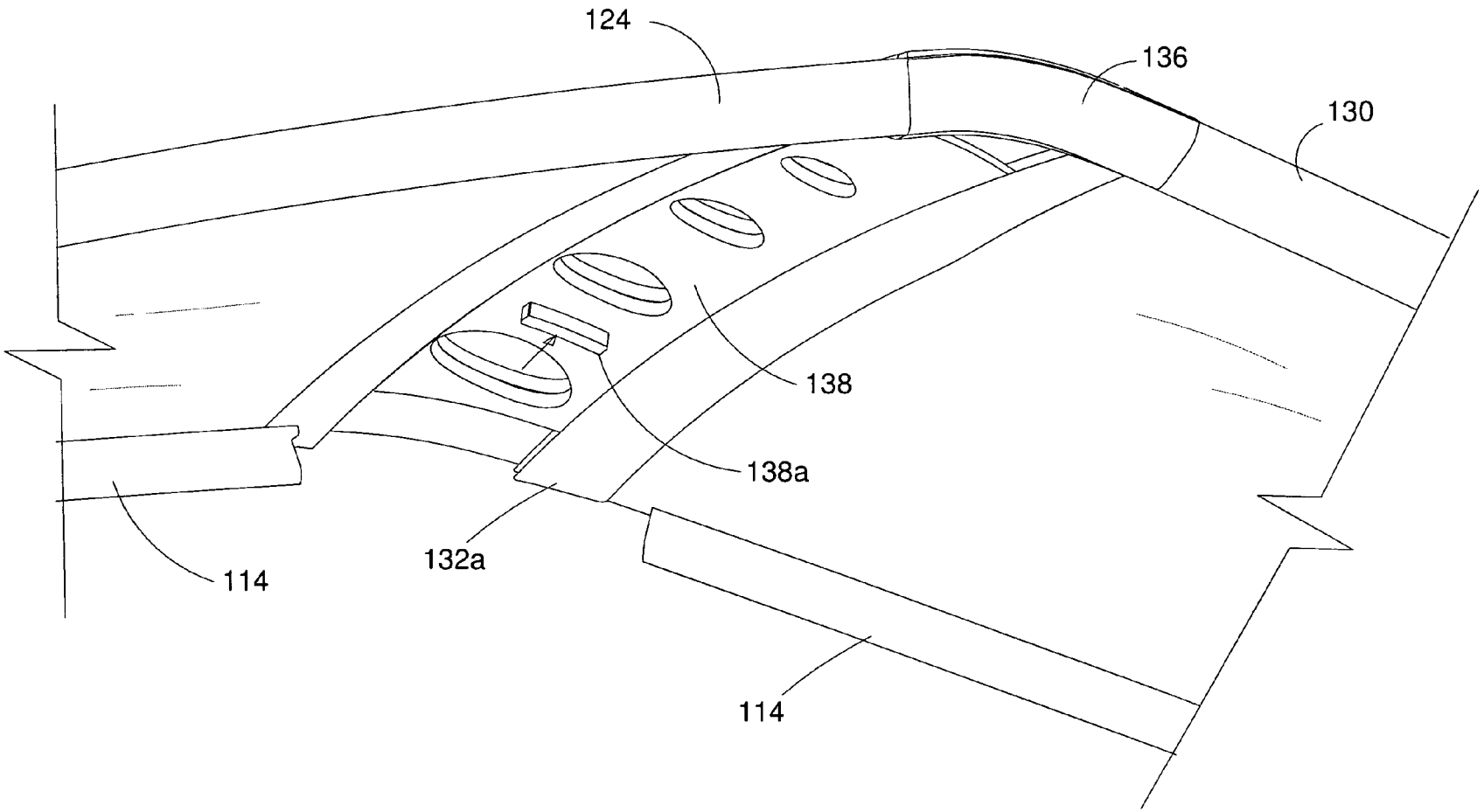
FIG. 6 is a segmented perspective view as viewed from above the cockpit area showing the top rails and corner post, with a corner post cap in place, and showing the vent cover open.

As shown in FIG. 6 a partial perspective view of windshield frame 110 as viewed from just above the cockpit area 116, where right-hand corner post 132*a*, mates with base frame rail 114, top frame rail 124 and alternate rearward top frame rail 130. Corner post is shown having vent holes 134 and vent hole cover 138, where vent hole cover 138 includes vent hole cover handle 138*a*. In this view vent cover 138 is in the open position.

Figure 7:
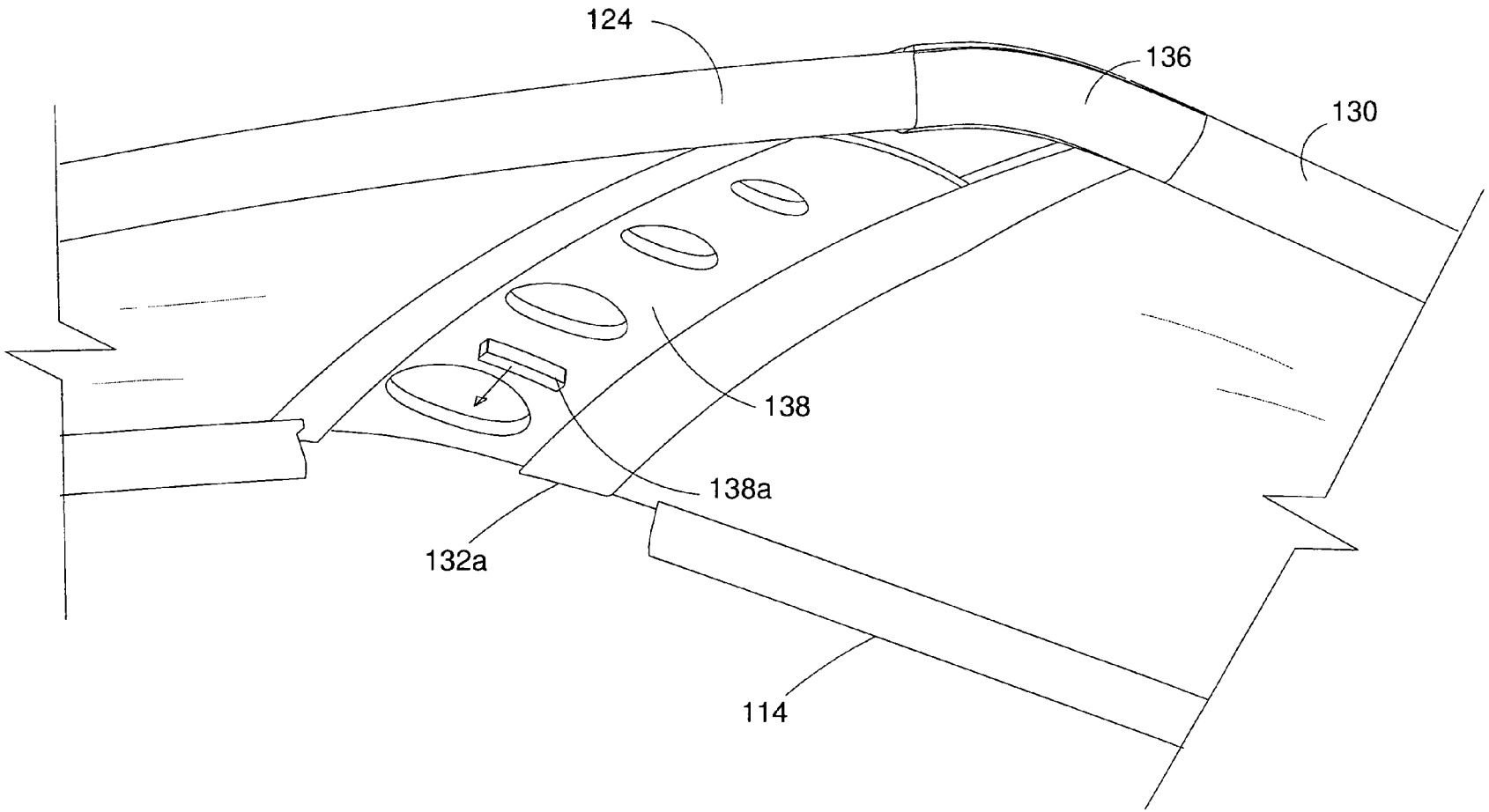
FIG. 7 is a segmented perspective view as viewed from above the cockpit area showing the top rails and corner post, with the corner post cap in place, and showing the vent cover closed.

As shown in FIG. 7 a partial perspective view of windshield frame similar to FIG. 5, where in this view vent hole cover 138 is in the closed position.

Figure 8B:
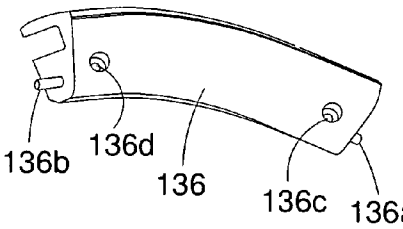
FIG. 8*b* is a perspective view showing the corner post cap, away from attaching frame members.
Figure 8A:
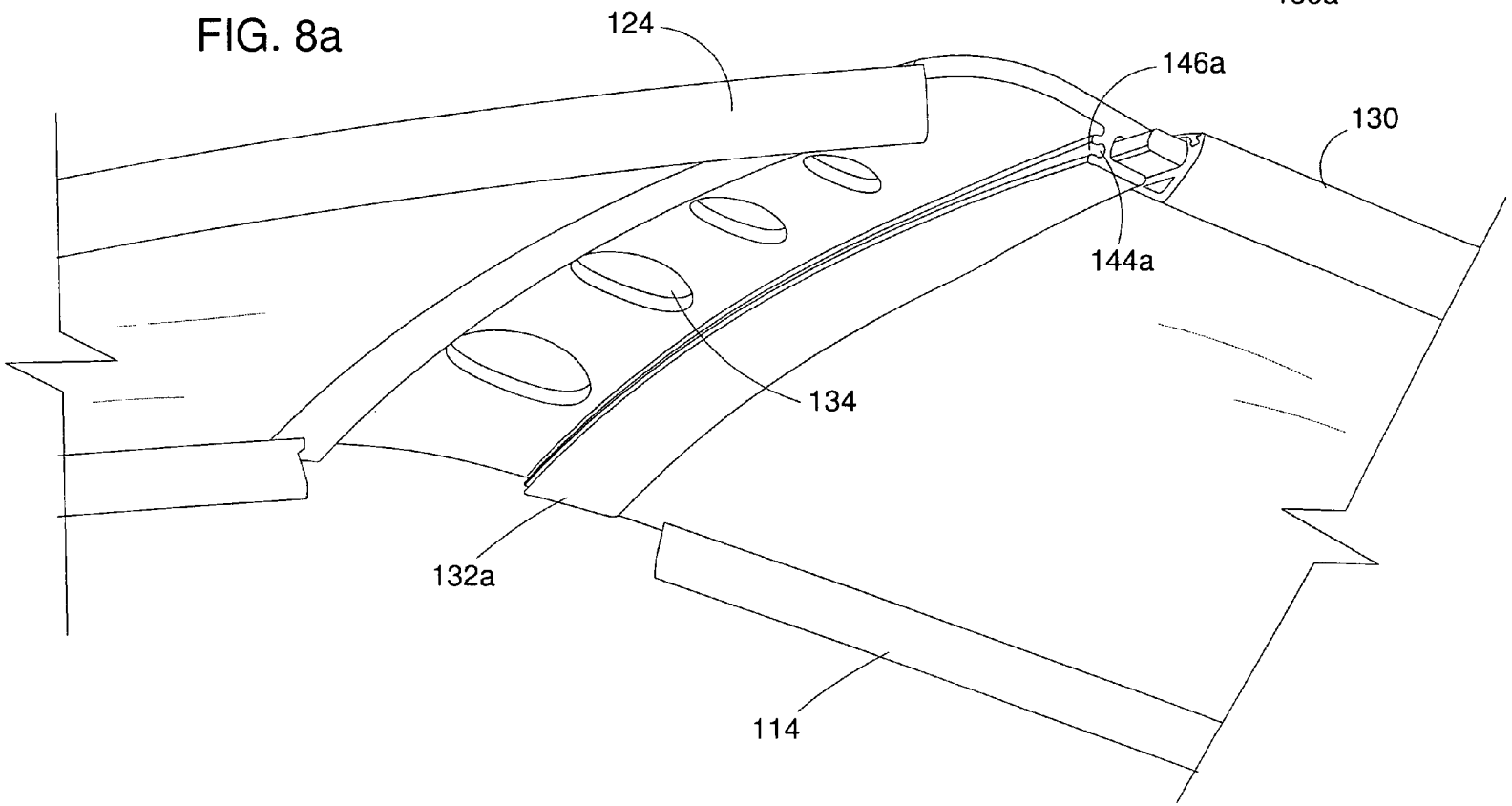
FIG. 8*a* is a segmented perspective view as viewed from above the cockpit area showing the top rails and corner post, with the corner post cap removed.

As shown in FIG. 8*a*, a partial perspective view of windshield frame 110 as viewed from just above the cockpit area 116, right-hand corner post 132*a* is shown with corner cap 136 removed. As shown in FIG. 8*b*, cap 136 is shown away from corner post 132*a*. Corner post cap 136 may include alignment pins 136*a* and 136*b*, to support alignment of cap 136 with top frame rail 124 and alternate top frame rail 130. Corner post cap 136 may also screw holes 136*c* and 136*d*.

Figure 9:
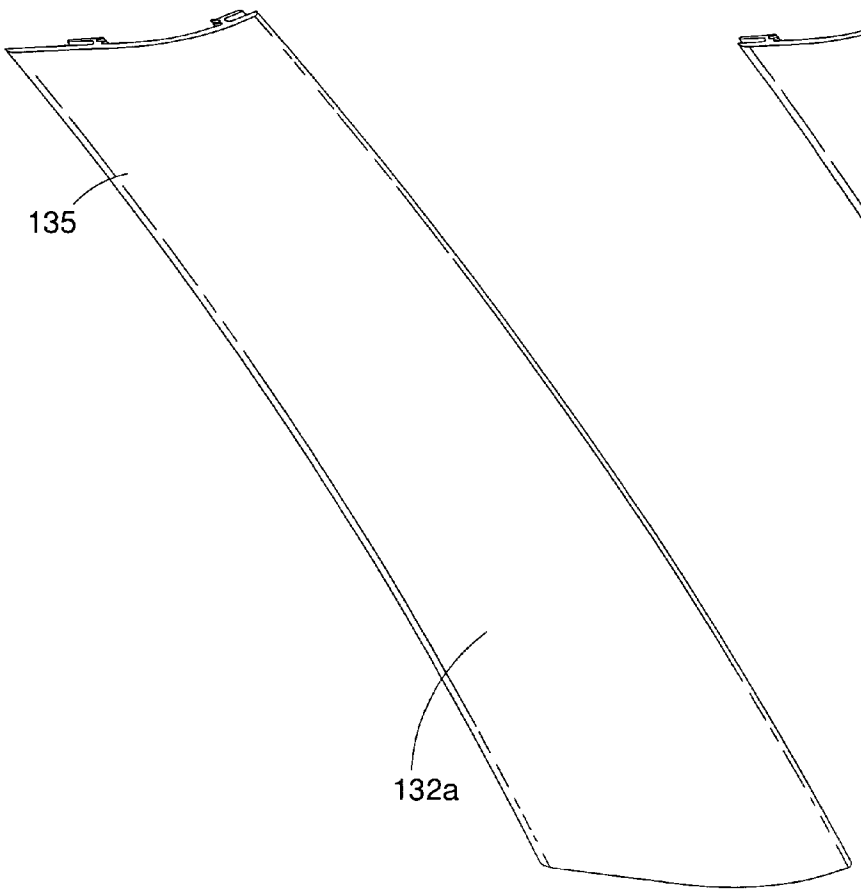
FIG. 9 is a perspective frontal view of a corner post extrusion after stretch-forming and trimming, and before machining.

As shown in FIG. 9 in a perspective view, corner post 132*a* is shown after stretch-forming and trimming, and before machining.

Figure 10:
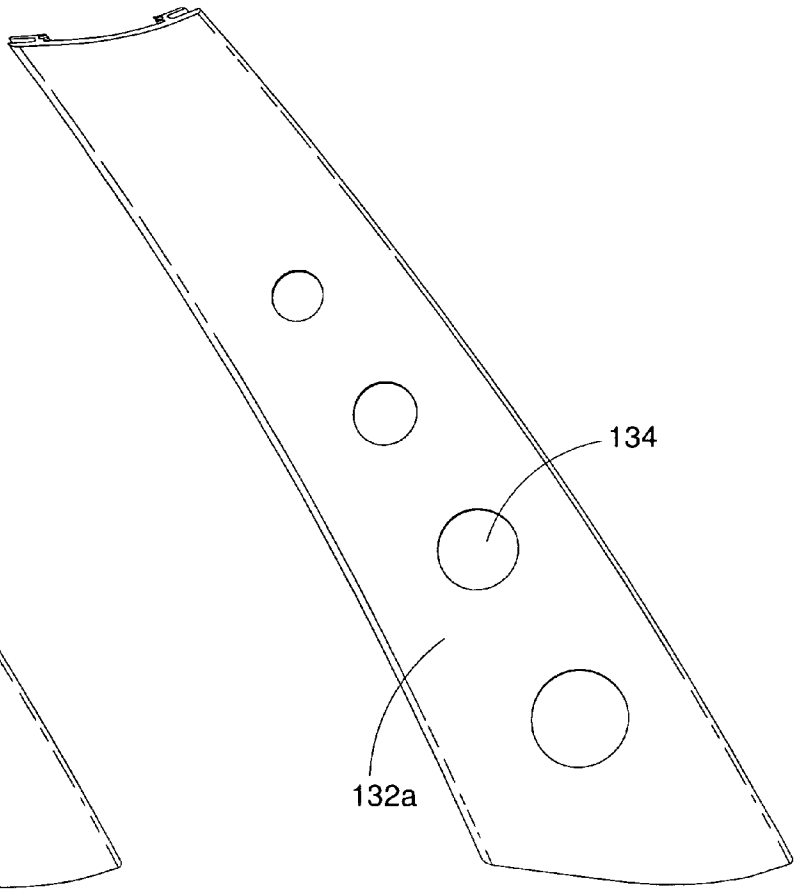
FIG. 10 is a perspective frontal view of a finished corner post with vent holes.

As shown in FIG. 10 in a perspective view, corner post 132*a* is shown finished, including with an outward upper edge taper 135, and with vent holes 134 therein.

Figure 11:
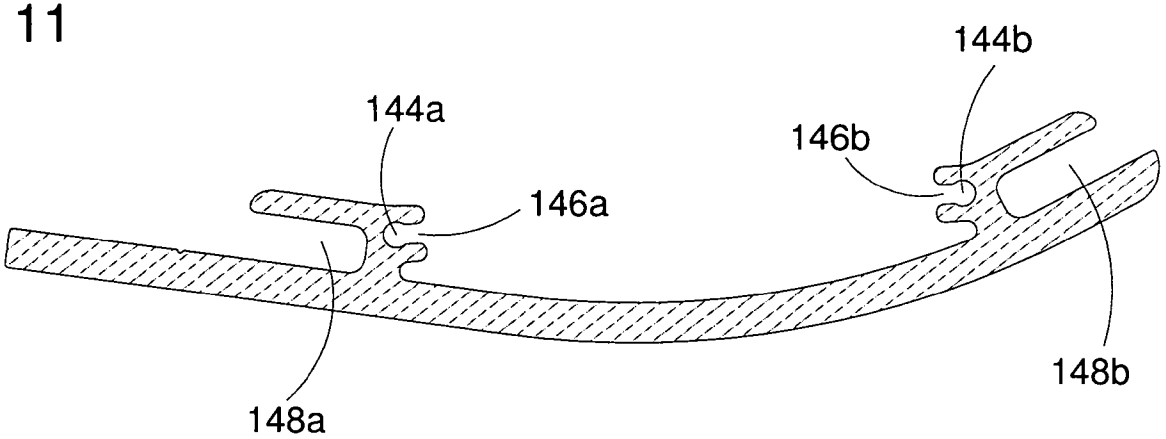
FIG. 11 is a cross-sectional view of the corner post extrusion.

Shown in FIG. 11 is a cross-section of corner posts 132*a* and 132*b*. Corner posts 132*a* and 132*b* include a pair of screw chases 144*a* and 144*b* and where external area of screw chases 144*a* and 144*b* include slots 146*a* and 146*b*, for vertical sliding of vent cover 138, to open and close vent cover 138. Corner posts 132*a* and 132*b* also includes a pair of windshield glass receiving slots 148*a* and 148*b*, and outward upper edge 135.

Figure 11A:
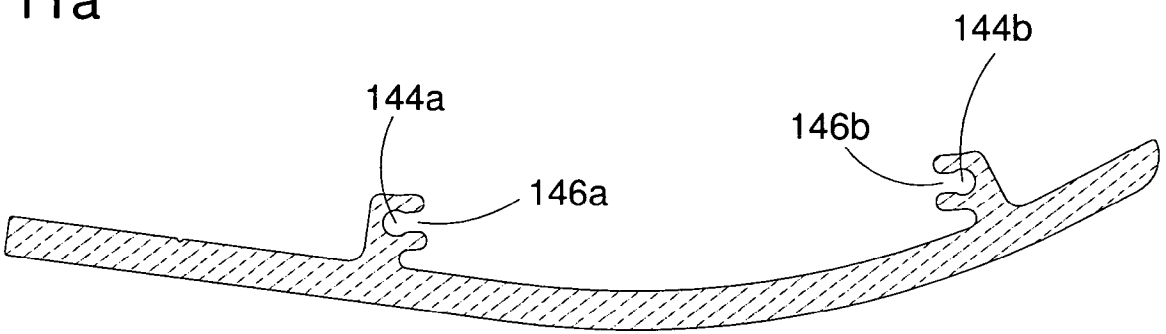
FIG. 11*a* is a cross-sectional view of an alternate corner post.

In FIG. 11*a*, a cross-sectional view shows an alternate corner post, where no glass receiving slots are required. This is employed when adhesive is used to attach the corner post to the windshield glass.

Figure 12:
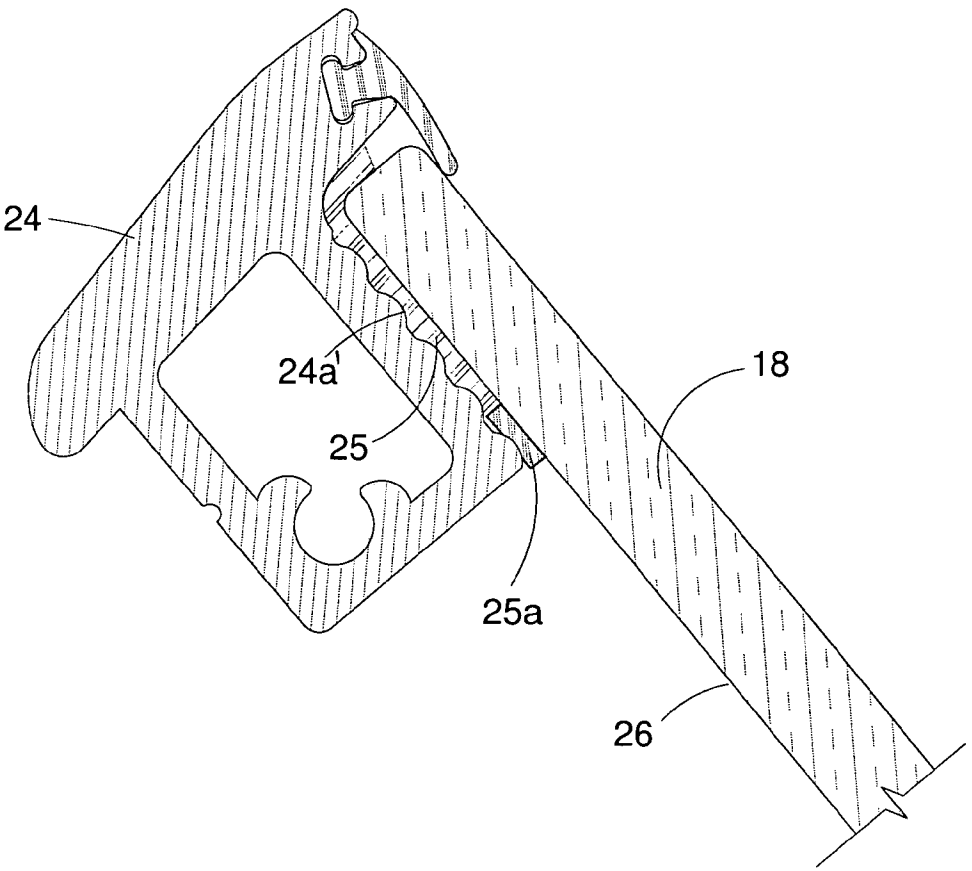
FIG. 12 is a segmented cross-sectional view of the top rail of the windshield frame taken along line A from FIG. 1 and as taken along line B from FIG. 2, showing an alternate ribbed surface of top frame rail that extends the adhesive contact surface area.

As shown in FIG. 12 a partial cross-sectional view taken along line A from FIG. 1, and also an identical section as taken along line B from FIG. 2, where the elongate top frame rail 24 is shown mounted substantially flush with windshield glass 18's exterior surface 19. The windshield glass 18 is shown adhesively fastened, or glued, where adhesive fastener 25 is shown between top rail 24 and windshield glass 18's interior surface 26, and where an alternate ribbed surface 24*a*' of top frame rail 24 is used to extend the adhesive contact surface area.

Figure 13:
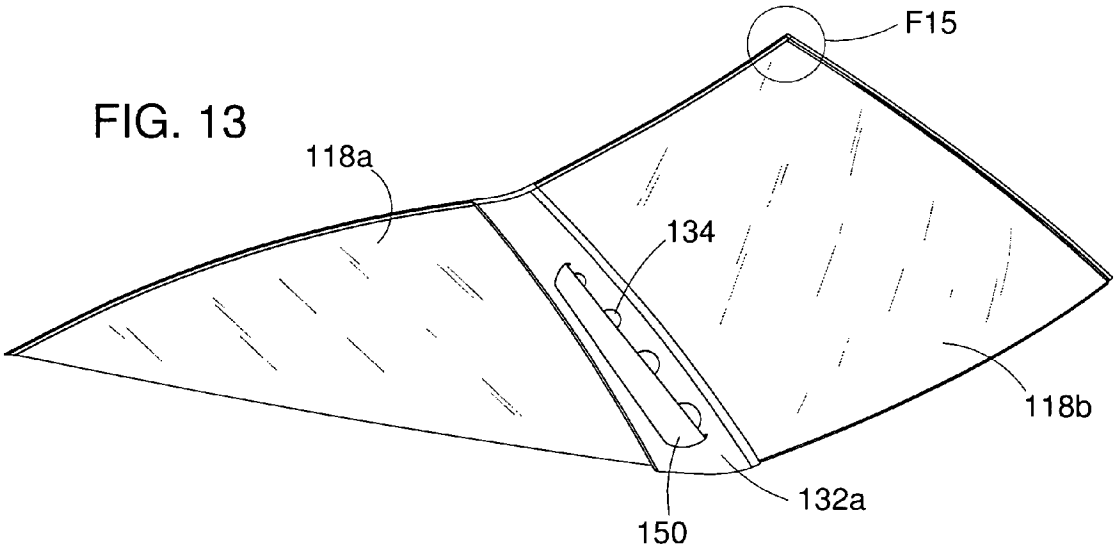
FIG. 13 is a perspective frontal view of a windshield assembly showing an air scoop attached rearward of the corner vent holes.

As shown in FIG. 13 in a perspective frontal view of a windshield assembly, an air scoop 150 is attached over the corner vent holes.

Figure 14:
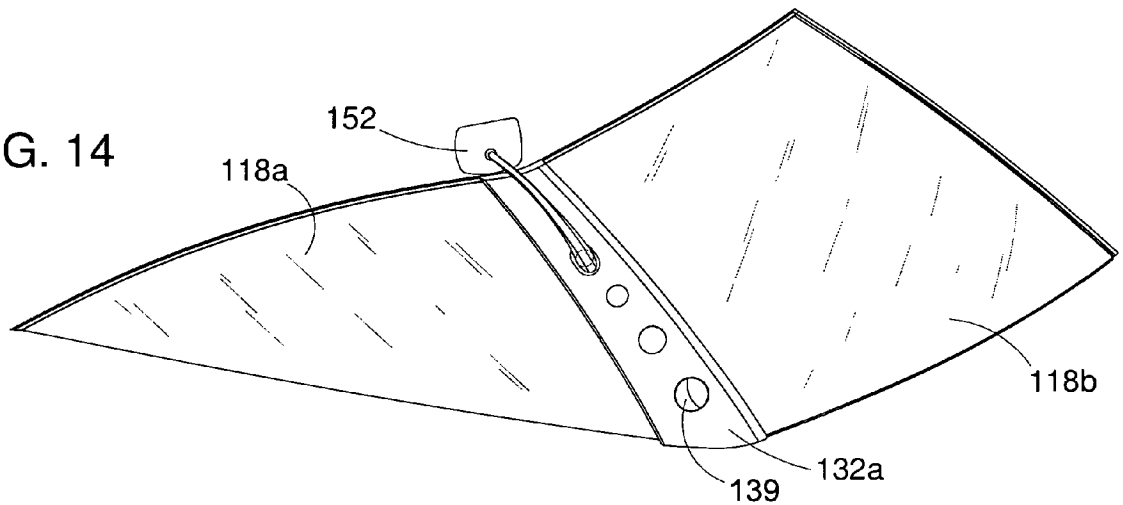
FIG. 14 is a perspective frontal view of a windshield assembly showing a mirror attached to the upper corner vent hole and a hemispherical vent is shown attached within the lower corner vent hole.

As shown in FIG. 14 in a perspective frontal view of a windshield assembly, a mirror bracket 152 is attached using the upper vent hole.

Also shown in FIG. 14, a hemispherical vent 139 is attached within the bottom vent hole, where the vent can be open or closed by rotation of the hemispherical vent 139 to provide a stream of air to the cockpit area.

Figure 15:
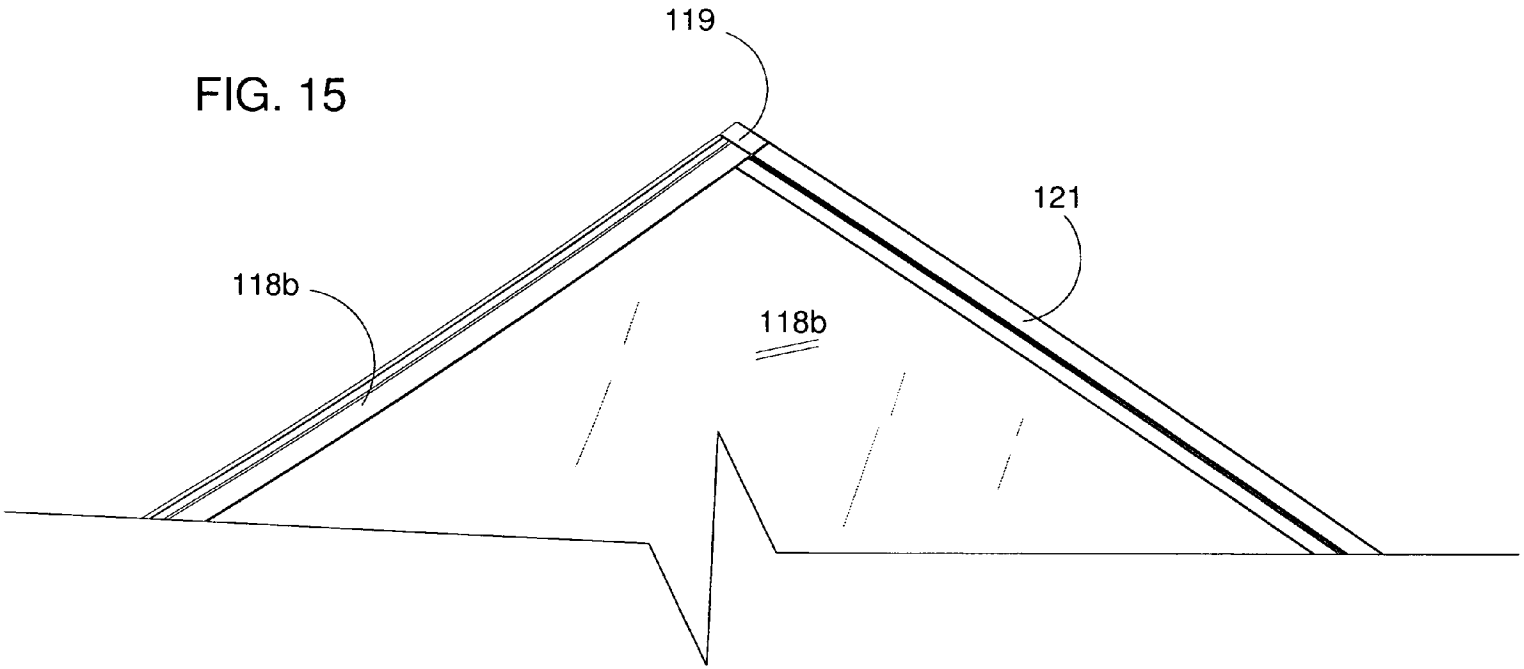
FIG. 15 is a sectional perspective frontal view of the windshield assembly taken from circle F15 in FIG. 13 showing a corner connector block attached.

As shown in FIG. 15 in a segmented perspective frontal view of the windshield assembly taken from circle F15 in FIG. 13, shows a corner connector block 119 attached to the top windshield frame rail and the vertical oriented hatch door rail 121.

Figure 15A:
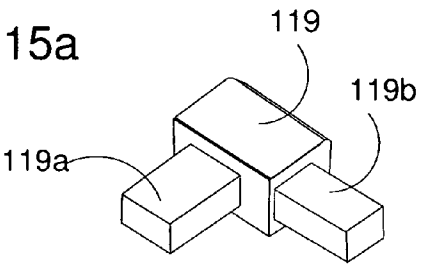
FIG. 15*a* is a perspective frontal view showing a corner connector block unattached.

As shown in FIG. 15*a* is a perspective frontal view showing a corner connector block 119 unattached. Corner connector 119 includes tabs 119*a* and 119*b*. Where tab 119*a* inserts into top windshield frame rail 118*b* and tab 119*b* inserts into vertically oriented hatch rail 121.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. These modifications may include forming the base members separately and reversing male and female members. The embodiments were chosen and described in order to best explain the principles of the invention and its practical application, to thereby enable others skilled in the art to best utilize the invention and various embodiments with various modifications as are suited to the particular use contemplated.

It is intended that the scope of the invention be defined by the Claims appended hereto and their equivalents.

What is claimed is:

1. A marine windshield frame for curved or straight windshield glass, mounted to a boat deck having a frontal, middle and rearward area and a cockpit substantially within said boat deck middle area, where said cockpit has a frontal and rearward area, comprising:

an elongate base frame member rail mountable onto said boat deck substantially around the frontal area of said cockpit, where said elongate base frame member rail longitudinally extends around bottom of said windshield glass;

an elongate top frame member rail longitudinally extending around top of said windshield glass, where said elongate top frame member rail is mounted substantially inward of said windshield glass and oriented toward said cockpit, where said elongate top frame member rail is mounted substantially flush with frontal area of said windshield glass, where said windshield glass is adhesively fastened to said top frame member rail, where said top frame member rail and said windshield glass include multiple sections, and further comprising a pair of vertically oriented corner posts, where said vertically oriented corner posts each includes a bottom end, an outboard side edge, a frontal surface, an inboard side edge, a rearward surface and a top end, where said corner post bottom end mates with said base frame member rail, said inboard side edge and said outboard side edge mate with said windshield glass sections; and where said corner post top end aligns to said top frame member rail.

2. The marine windshield frame of claim 1 where said top frame member rail having multiple sections is continuous to matingly cover said vertically oriented corner post top end.

3. The marine windshield frame of claim 1 where said pair of vertically oriented corner posts, include a top cap to cover said corner post top end, where said top cap aligns flush with said top frame member rail sections.

4. The marine windshield frame of claim 1 where said pair of vertically oriented corner posts are made of castings.

5. The marine windshield frame of claim 1 where said pair of vertically oriented corner posts are made of a stretch-formed aluminium alloy extrusion.

6. The marine windshield frame of claim 1 where said pair of vertically oriented corner posts have vent holes therethrough.

7. The marine windshield frame of claim 6 where said pair of vertically oriented corner posts have air scoops mountedly fixed thereon said fontal surface.

8. The marine windshield frame of claim 6 where said pair of vertically oriented corner posts have air scoops mounted therein said vent holes, where said air scoops are hemispherical and are rotatable for opening and closing of said air scoops.

9. The marine windshield frame of claim 6 where said pair of vertically oriented corner posts have a mirror bracket mountedly fixed therein at least one of said vent holes.

10. The marine windshield frame of claim 6 where said pair of corner posts have a pair of inward facing tracks for guiding a slidable cover therein, for slidably opening and closing said vent holes.

11. The marine windshield frame of claim 1 where said pair of vertically oriented corner posts have substantially vertical tapers.

12. The marine windshield frame of claim 1 where said pair of vertically oriented corner posts have a longitudinal semicircular shape thereon said frontal surface.

13. The marine windshield frame of claim 12 where said pair of vertically oriented corner posts have a longitudinal segmented chamfered shape thereon said longitudinal semi-circular frontal surface.

14. A marine windshield frame for curved or straight windshield glass, mounted to a boat deck having a frontal, middle and rearward area and a cockpit substantially within said boat deck middle area, where said cockpit has a frontal and rearward area, comprising:

an elongate base frame member rail mountable onto said boat deck substantially around the frontal area of said cockpit, where said elongate base frame member rail longitudinally extends around bottom of said windshield glass;

an elongate top frame member rail longitudinally extending around top of said windshield glass, where said elongate top frame member rail is mounted substantially inward of said windshield glass and oriented toward said cockpit, where said elongate top frame member rail is mounted substantially flush with frontal area of said windshield glass, where said windshield glass is adhesively fastened to said top frame member rail, where said elongated top frame member rail has an elongated ribbed surface oriented towards inward glass surface, so as to extend the adhesive contact surface area.

15. A method of manufacturing a marine windshield frame corner post for curved or straight windshield glass sections, comprising the steps of;

a) extruding an aluminium alloy shape, having a widened frontal area;

b) forming said aluminium extrusion to correspond with said windshield glass;

c) milling a taper on at least one side of said formed extrusion;

d) trimming said formed aluminium extrusion to length;

e) mounting said corner post to at least two windshield glass members; and f) mounting said corner post and said windshield glass members together with at least one bottom windshield frame rail and at least one top windshield frame rail.

16. The method of manufacturing a marine windshield frame corner post of claim 15 further comprising machining at least one vent hole therethrough mid section of said frontal area of said corner post.

17. The method of manufacturing a marine windshield frame corner post of claim 15 further comprising forming said top windshield frame rail around said windshield glass sections, inclusively over said corner post therebetween.

18. The method of manufacturing a marine windshield frame corner post of claim 15 further comprising adding a top finishing cap onto top of said corner post to matingly align with said top windshield frame rails.

19. A marine windshield frame for curved or straight windshield glass, mounted to a boat deck having a frontal, middle and rearward area and a cockpit substantially within a boat deck middle-area, where said cockpit has a frontal and rearward area, comprising:

an elongate base frame member rail mountable onto said boat deck substantially around the frontal area of said cockpit, where said elongate base frame member rail longitudinally extends around bottom of said windshield glass;

an elongate top frame member rail longitudinally extending around top of said windshield glass, where said top frame member rail and said windshield glass include multiple sections;

a pair of vertically oriented corner posts, where said vertically oriented corner posts each include a bottom end, an outboard side edge, a frontal surface, an inboard side edge, a rearward surface and a top end, where said corner posts bottom end mates with said base frame member rail and, said inboard side edge and said outboard side edge mate with said windshield glass sections, and said corner posts top end aligns to said top frame member rail, and;

further comprising a substantial vertically oriented longitudinal semi-circular shape, having substantially vertical tapers thereon said frontal surface, with vent holes therethrough said vertically oriented corner posts.

20. The marine windshield frame of claim 19 where said top frame member rail having multiple sections is continuous to matingly cover said vertically oriented corner post top end.

21. The marine windshield frame of claim 19 where said pair of vertically oriented corner posts have air scoops mountedly fixed thereon said fontal surface.

22. The marine windshield frame of claim 19 where said pair of vertically oriented corner posts have air scoops mounted therein said vent holes, where said air scoops are hemispherical and are rotatable for opening and closing of said air scoops.

23. The marine windshield frame of claim 19 where said pair of vertically oriented corner posts have a mirror bracket mountedly fixed therein at least one of said vent holes.

24. The marine windshield frame of claim 19 where said pair of corner posts have a pair of inward facing tracks for guiding a slidable cover therein, for slidably opening and closing said vent holes.

* * * * *